US009031836B2

(12) United States Patent
Michaelis et al.

(10) Patent No.: US 9,031,836 B2
(45) Date of Patent: May 12, 2015

(54) METHOD AND APPARATUS FOR AUTOMATIC COMMUNICATIONS SYSTEM INTELLIGIBILITY TESTING AND OPTIMIZATION

(75) Inventors: Paul Roller Michaelis, Louisville, CO (US); Paul Haig, Carrying Place (CA); John C. Lynch, Belleville (CA); Chris McArthur, Belleville (CA)

(73) Assignee: Avaya Inc., Basking Ridge, NJ (US)

( * ) Notice: Subject to any disclaimer, the term of this patent is extended or adjusted under 35 U.S.C. 154(b) by 196 days.

(21) Appl. No.: 13/569,946

(22) Filed: Aug. 8, 2012

(65) Prior Publication Data

US 2014/0046656 A1 Feb. 13, 2014

(51) Int. Cl.

| | |
|---|---|
| ***G10L 21/02*** | (2013.01) |
| ***H04R 29/00*** | (2006.01) |
| *G10L 21/0364* | (2013.01) |
| *G10L 21/057* | (2013.01) |

(52) U.S. Cl.

CPC ..... *G10L 21/02* (2013.01); *G10L 21/0364* (2013.01); *G10L 21/057* (2013.01)

(58) Field of Classification Search

None

See application file for complete search history.

(56) References Cited

U.S. PATENT DOCUMENTS

| | | | | |
|---|---|---|---|---|
| 5,737,719 | A * | 4/1998 | Terry | 704/224 |
| 6,026,361 | A * | 2/2000 | Hura | 704/270 |
| 6,061,431 | A | 5/2000 | Knappe et al. | |
| 6,889,186 | B1 | 5/2005 | Michaelis | |
| 6,913,578 | B2 | 7/2005 | Hou | |
| 7,177,417 | B2 | 2/2007 | Michaelis | |
| 7,483,831 | B2 * | 1/2009 | Rankovic | 704/225 |
| 7,584,010 | B2 | 9/2009 | Waldron et al. | |
| 7,831,025 | B1 * | 11/2010 | Francis et al. | 379/1.01 |
| 8,195,453 | B2 * | 6/2012 | Cornell et al. | 704/226 |
| 8,433,568 | B2 * | 4/2013 | Krause et al. | 704/237 |
| 8,706,919 | B1 * | 4/2014 | Eisner | 710/8 |
| 2006/0045281 | A1 * | 3/2006 | Korneluk et al. | 381/60 |
| 2008/0254753 | A1 | 10/2008 | Steenstra et al. | |
| 2010/0098262 | A1 * | 4/2010 | Frohlich | 381/60 |
| 2010/0329490 | A1 * | 12/2010 | Van Schijndel et al. | 381/314 |
| 2012/0051569 | A1 * | 3/2012 | Blamey et al. | 381/314 |

* cited by examiner

*Primary Examiner* — Brian Albertalli

(74) *Attorney, Agent, or Firm* — Sheridan Ross P.C.

(57) ABSTRACT

Systems and methods for automatic user specific, condition specific communication system intelligibility testing and optimization are provided. The intelligibility of speech for a particular user is determined using a test of intelligibility administered by an interactive voice response (IVR) application running on a communication server. The intelligibility test can be run for a particular user under different conditions. For each user and/or set of conditions, a set of speech signal adjustment parameters can be determined. A set of speech signal adjustment parameters that will enhance the intelligibility of a speech signal for a user are applied when that user is involved in a communication session. The particular set of speech signal adjustment parameters selected can depend on the communication equipment and/or environment associated with the communication session.

20 Claims, 3 Drawing Sheets

METHOD AND APPARATUS FOR AUTOMATIC COMMUNICATIONS SYSTEM INTELLIGIBILITY TESTING AND OPTIMIZATION

FIELD

Methods and apparatus for automatic user-specific, condition-specific communication system intelligibility testing and optimization are provided.

BACKGROUND

The hearing loss experienced by people who are hard of hearing is rarely uniform across the entire audio spectrum. For example, a person's hearing may be down by only 5 dB at 500 Hz, and down by 20 dB at 2,000 Hz. For users with this type of hearing loss, it can be helpful to provide a compensating amount of amplification at frequencies where the user is known to have a specific amount of hearing loss. Using the above example, this compensation could be a 5 dB boost at 500 Hz and a 20 dB boost at 2,000 Hz. An underlying assumption of this approach is that intelligibility, i.e., the ability for a listener to discriminate between two essentially similar sounds, is highly correlated with the ability to perceive all frequencies in the acoustic spectrum at the correct amplitude.

Although there are electronic audio devices that allow users to adjust the spectral characteristics for themselves, typically via what are commonly referred to as "tone controls" or "graphic equalizers," a problem with this approach when applied to telecommunication systems is that users tend to adjust the characteristics to maximize the aesthetic quality of the voice rather than the intelligibility. (The inability of hard of hearing users to self-adjust audio systems optimally is a reason why audiologists, and not the individual users, make the spectral adjustments on users' hearing aids.) But perhaps the most important reason why self-adjustment of the spectral characteristics may not yield optimal speech intelligibility for hard of hearing users is that certain types of audio degradation that are common in telecommunication systems can affect these users differently from users with normal hearing, and are best mitigated through techniques that do not rely exclusively on simple spectral compensation. Examples include the distortions introduced by audio compression (e.g., GSM or G.729), packet loss, ambient noise, transducer quality, and poor signal to noise ratio. In this context, it is important to note that the optimal mitigation strategy will differ among individuals depending on the nature of the individual's hearing loss.

In summary, when considering the needs of hard of hearing users of telecommunication systems:

(a) Optimal intelligibility is not reliably achieved when users self-adjust the audio characteristics of the device.

(b) Many of the audio distortions commonly experienced in telecommunication systems are best mitigated on a per-user basis through techniques that are not limited to simple spectral compensation.

For these reasons, a method is required that relies on the results of individually administered intelligibility tests (rather than hearing acuity tests) to provide automatic optimization of audio factors that include, but are not limited to, spectral adjustments.

SUMMARY

Systems and methods for improving the intelligibility of speech delivered to a user through a communication system are provided. More particularly, an automatic user-specific, condition-specific intelligibility testing and optimization system and method are provided. According to embodiments of disclosed invention, an intelligibility test is automatically administered to a user that evaluates the user's ability to discriminate between two essentially similar speech sounds. After administering the intelligibility test, the results are analyzed, and modifications are made to the speech signal by the system automatically in order to maximize the intelligibility of speech for the user.

Systems in accordance with the present disclosure include a communication server or set of communication servers and at least one user endpoint. The communication server includes or has access to an interactive voice response (IVR) system or script that operates to administer the intelligibility test. The communication server additionally includes application programming that can identify patterns in the user's ability, or inability, to discriminate between different speech sounds. The communication server can then identify audio adjustments that would maximize intelligibility for the user and make the adjustments automatically. The system can additionally identify how user specific discrimination patterns change as a function of factors associated with the communication or telecom system and the user's environment. Sets of different automatic adjustments for a user can be stored for use by a user in connection with different communication systems and/or communication devices following the intelligibility testing and analysis.

Methods in accordance with embodiments of the present disclosure include initiating a communication session between a user and a communication server. After establishing the communication session, the communication server administers an intelligibility test for the user of the communication device. The user's responses are analyzed, and used to identify patterns in the user's ability, or inability, to discriminate between speech sounds. The method further includes using the user responses to identify adjustments to the output parameters of the speech signal in order to maximize the intelligibility of speech signals for the user. The adjustments are then applied automatically. The automatic adjustments or compensation can include, but are not limited to, spectral shaping and/or modifications to frames of speech signal data. Embodiments of the method additionally include performing automatic optimization of intelligibility for different users, and applying different adjustments to reproduced audio signals for the different users. Further embodiments of the present disclosure can include performing intelligibility tests for a user under different conditions and/or using different communication devices or systems, and applying the adjustments determined best suited for the different conditions devices or systems.

Additional features and advantages of embodiments of the present disclosure will become more readily apparent from the following description, particularly when taken together with the accompanying drawings.

DETAILED DESCRIPTION

Figure 1:
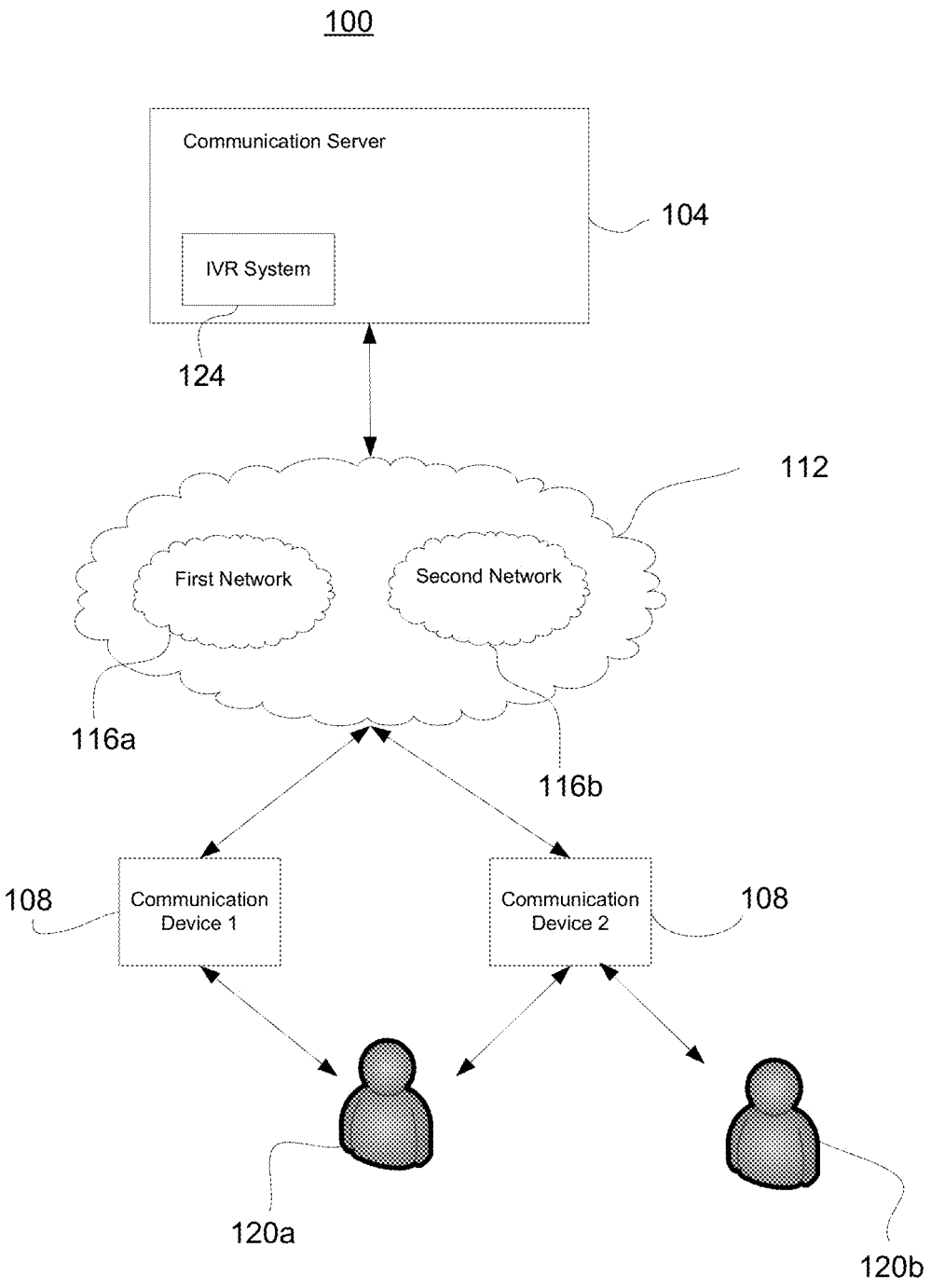
FIG. 1 illustrates components of a communication system in accordance with embodiments of the present disclosure.

FIG. 1 depicts a communication system 100 in accordance with embodiments of the present disclosure. In general, the system 100 includes a communication server 104 interconnected to one or more communication devices or endpoints 108 via a communication network 112. The communication network 112 can include multiple networks of different types. For example, the communication network can comprise a first network 116 implementing a first audio encoding algorithm for carrying speech signals associated with a first communication endpoint 108, and a second network 116*b* utilizing a second audio encoding algorithm for transmitting speech signals with respect to a second communication endpoint 108. The communication endpoints 108 are each associated with one or more users 120.

The communication server 104 may comprise a general purpose computer or server device. The communication server 104 can include an interactive voice response (IVR) system 124 that is operable to administer an intelligibility test to a user 120, as described in greater detail elsewhere herein. The communication server 104 can additionally include an analysis and modification unit, that operates to determine and implement adjustments to the reproduction of speech for a user 120 through a communication device 108 as described herein.

A communication endpoint or device 108 may comprise a desktop telephone, cellular telephone, soft phone, two-way radio, or other device capable of supporting voice communications or the delivery of speech to the user 116. In addition, different communication endpoints 108 can be associated with different networks or audio encoding algorithms. In general, each communication endpoint 108 is associated with at least one user 120. In addition, one user 120 may be associated with multiple communication devices 108. For example, one user 120 may be associated with a first communication device 108*a* comprising a desk phone, and a second communication device 108*b* comprising a cellular telephone. As can be appreciated by one of skill in the art, different telephones can operate with different networks 112 and different audio encoding algorithms, which affect the quality and characteristics of speech or audio signals.

All the functions defined in the communication server 104 as well as an emulation of the network 112 may reside within the communication endpoint or device 108. For example, the communication device 108 could encode speech in one of many available codecs, feed the resultant encoded bit stream through network emulation software such as found in Netem that replicates real network conditions and then capture the bit stream out of this network function and decode this to speech that in real-time is played out the speaker of the communication device 108. It is equally valuable to do this in the different user acoustic environments as described elsewhere.

Figure 2:
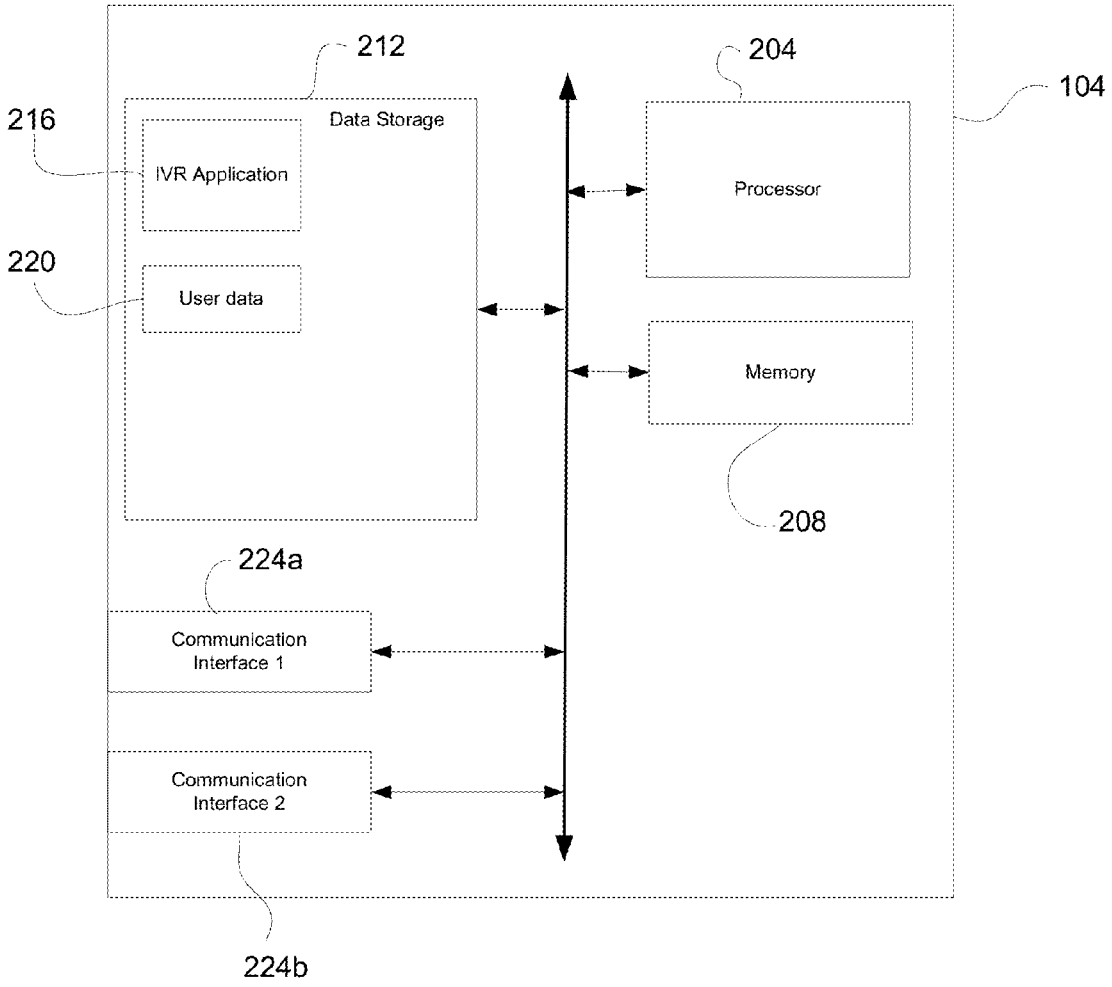
FIG. 2 depicts components of a communication server in accordance with embodiments of the present disclosure.

With reference now to FIG. 2, components of a communication server 104 in accordance with embodiments of the present disclosure are depicted. In general, the communication server 104 includes a processor 204. The processor 204 may comprise a general purpose programmable processor or controller for executing application programming or instructions. As a further example, the processor 204 may comprise a specially configured application specific integrated circuit (ASIC) or other integrated circuit, a digital signal processor, a programmable logic device, or the like. The processor 204 generally functions to run programming code or instructions, for example in the form of applications, implementing various functions of the communication server 104. Although shown as a single processor 204, the processor 204 may comprise multiple devices.

A communication server 104 can also include memory 208 for use in connection with the execution of application programming or instructions by the processor 204, and for the temporary or long term storage of program instructions and/or data. As an example, the memory 208 may comprise RAM, SDRAM, or other solid state memory. Alternatively or in addition, data storage 212 might be provided as part of a communication server 104. In accordance with embodiments of the present invention, data storage 212 can contain programming code or instructions implementing various of the applications or functions executed by the communication server 104. Like the memory 208, the data storage 212 may comprise a solid state memory device or devices. Alternatively or in addition, the data storage 212 may comprise a hard disk drive or other random access memory.

In accordance with embodiments of the present invention, the data storage 212 can include various applications and data. For example, the data storage 212 can include an IVR application 216, for example in connection with providing an IVR system 124 or IVR function as described herein. As a further example, the data storage 212 can include user data 220, such as information identifying individual users, and adjusted audible signal characteristics that are applied in connection with providing speech signals to particular users 120 and/or communication devices 108. A communication server 104 can additionally include one or more communication interfaces 224. For example, a first communication interface 224*a* can be provided to operably interconnect the communication server 104 to a first network 116*a,* and a second communication interface 224*b* can be provided to interconnect the communication server 104 to the second network 116*b.*

Figure 3:
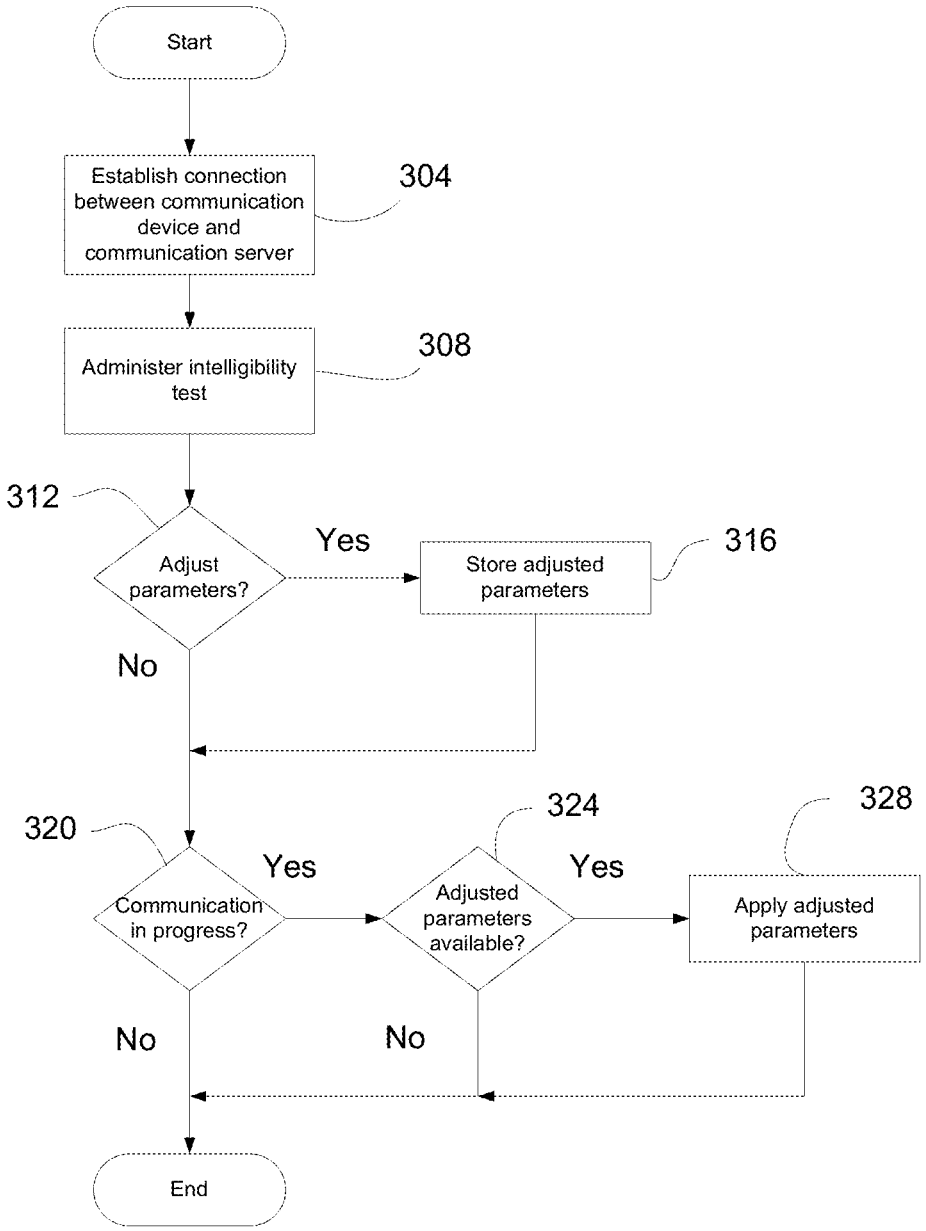
FIG. 3 is a flowchart depicting aspects of a method for performing automatic user-specific, condition-specific intelligibility testing and optimization in accordance with embodiments of the present disclosure.

FIG. 3 is a flowchart illustrating aspects of the operation of a system 100 in accordance with embodiments of the disclosed invention. Initially, a connection between a communication device 108 and the communication server 104 is established (step 304). At step 308, an intelligibility test is administered. In accordance with embodiments of the present disclosure, the intelligibility test determines the ability of a user 120 to understand speech transmitted as a speech signal by a communication network 112 and output by a communication device 108. Moreover, the intelligibility test is not limited to a set of tones. Instead, the tests can be implemented as interactive voice response (IVR) scripts that provide example speech to the user, and analyze the responses of the user 120 to identify patterns in the user's 120 ability, or inability, to discriminate between different speech sounds. More particularly, the IVR system 124, for example as implemented through the execution of the IVR application 216 by the communication server 104, can administer a diagnostic rhyme test (DRT) and/or modified rhyme test (MRT) test.

At step 312, a determination can be made as to whether adjustments to the speech signal parameters are warranted, based on the responses of the user 120 to the speech intelligibility test. If changes to the parameters of the speech signal are warranted, the adjustments that the administration of the intelligibility test determined were applicable to the user 120 can be stored (step 316), for example as part of user data 220. The stored, adjusted speech signal parameters can then be made available for later communications involving the user 120 and the communication endpoint 108.

After storing the adjusted speech signal parameters, or after determining that adjustment to the parameters are not required, a determination can be made as to whether a communication is in progress (step 320). If a communication is determined to be in progress, a next determination can be made as to whether adjusted speech signal parameters are available for a communication device 108 or user 120 involved in the communication (step 324). If adjusted parameters are available, they can be applied in connection with the communication (step 328). The application of adjusted speech signal parameters can include modifying the speech signal provided by the communication server 104 to the communication device 108 associated with the user 120 for whom adjusted speech signal parameters have been determined as a part of the administration of an intelligibility test as described herein. The adjusted speech signal parameters can include spectral shaping, in which different frequencies of an audio frequency are amplified or attenuated in order to improve the intelligibility of the speech signal to the user 120. As a further example, the adjusted speech signal parameters can include adjustments to the length of data frames containing the audio data comprising the speech signal. For example, by lengthening data frames containing plosive sounds, the intelligibility of such sounds can be improved. Another technique for improving the intelligibility of speech, which is described in U.S. Pat. No. 6,889,186 to Michaelis, identifies portions of the speech signal that includes sounds that typically present intelligibility problems and modifies those portions in an appropriate manner. For example, the amplitude of frames determined to include unvoiced plosive sounds may be boosted. In addition, the amplitude of frames preceding such unvoiced plosive sounds can be reduced to better accentuate the plosive. After applying adjusted parameters, or after determining that no adjusted parameters are available, the process can end.

The intelligibility test can be administered in connection with each communication device 108 and/or network 112 in connection with which a user 120 may receive speech signals. Accordingly, a user 120 can connect to a communication server 104 for intelligibility testing in connection with different communication endpoints 108, networks 112, and/or combinations thereof. Speech signal adjustment parameters determined as a result of the intelligibility testing can be stored and applied subsequent to the intelligibility testing to the provision of speech signals to a user 120.

The application of speech signal adjustment parameters stored as part of the user's data 220 can depend on the communication device 108 and/or communication network 112 involved in a communication session with the user 120. Accordingly, different sets of speech signal adjustment parameters determined while testing the intelligibility of speech for a user 120 can be applied when different communication devices 108 and/or communication networks 112 are used to transmit speech signals to that user 120. In addition, different sets of speech signal adjustment parameters can be established through testing and applied in use for different communication environments. For example, a user 120 may have a set of speech signal adjustment parameters that are applied when the user 120 is involved in a communication session that uses a cellular telephone connected via a Bluetooth connection to a microphone and speakers provided as part of an automobile. As yet another example, a different set of speech signal adjustment parameters can be determined with respect to a particular communication endpoint 108 when that communication endpoint is being used in the home, a second set of speech signal adjustment parameters can be developed for application with that same communication endpoint 108 when the user 120 is on a city street, and yet another set of speech signal adjustment parameters can be applied when the user 120 is in an automobile. In accordance with still other embodiments, the conditions that affect intelligibility can change mid-call. Accordingly, the set of speech signal adjustment parameters that are applied can be changed during a call. For example, when the user moves from a quiet to a noisy environment or vice versa, changes in packet loss rates due to network congestion, or any other change that can be detected by the communication server 104 or endpoint 108 can result in an automatic change in the applied speech signal adjustment parameters. Accordingly, continuous optimization of the parameters is possible.

The establishment of different speech signal adjustment parameters for inclusion in user data 220 can be developed during a set-up or initialization process. Moreover, a user 120 can be provided with an opportunity to establish a new set of speech signal adjustment parameters for each new environment and/or combination of equipment 108, 112 associated with the communication. In this way, optimal or more favorable speech signal characteristics for a particular user 120 can be applied in different situations. The application of different speech signal adjustment parameters can be automatic, in that the communication server 104, for example through operation of the IVR application 216, can select a particular set of speech signal adjustment parameters for a particular set of equipment 108, 112, communication protocols, environments in which the user 120 is located during the communication session, etc. Alternatively, a user 120 can select a particular set of speech signal adjustment parameters for application during a communication session. In accordance with still other embodiments, different sets of speech signal adjustment parameters can be applied for different users 120 communicating with one another during the communication session. In particular, a first set of speech signal adjustment parameters can be drawn from user data 220 associated with a first user 120*a*, and a second set of speech signal adjustment parameters stored as user data 220 and associated with the second user 120*b* can be applied to speech signals provided to that second user 120.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A method for improving the intelligibility of reproduced speech, comprising:

performing a speech intelligibility test for a first user over a first network;

determining that the first user is involved in a communication session over the first network;

in response to determining that the first user is involved in the communication session over the first network, modifying at least a first sound parameter of an audio reproduction system based on results of the speech intelligibility test over the first network;

reproducing speech through the audio reproduction system using the at least a first modified sound parameter; and outputting the speech reproduced through the audio reproduction system using the at least a first modified sound parameter to the first user in the communication session over the first network.

2. The method of claim 1, wherein the speech intelligibility test includes using the audio reproduction system to output speech to a user.

3. The method of claim 2, wherein the speech output to the user as part of the speech intelligibility test includes a plurality of words.

4. The method of claim 3, wherein the plurality of words are monosyllabic and consist of a consonant-vowel-consonant sound sequence.

5. The method of claim 1, wherein modifying at least a first sound parameter includes spectral shaping.

6. The method of claim 1, wherein the speech reproduced by the audio reproduction system is received by the audio reproduction system as a series of time-based frames, and wherein modifying at least a first sound parameter includes modifying an amplitude of a least a first one of the frames based on the sound type associated with the frame.

7. The method of claim 1, wherein the speech intelligibility test is performed using a first communication device associated with the first user in a first ambient environment, wherein modifying at least a first sound parameter of an audio reproduction system includes applying a first set of modifications that include a first modification to the at least a first sound parameter, and wherein the reproducing speech through the audio reproduction system using the first set of modifications and the outputting the reproduced speech to the first user steps are performed while the first communication device is in a first environment.

8. The method of claim 7, further comprising:

performing the speech intelligibility test using one of the first communication device associated with the first user and a second communication device associated with the first user in a second ambient environment, wherein modifying at least a first sound parameter of an audio reproduction system includes a applying a second set of modifications that include a second modification to at least the first sound parameter;

reproducing speech through the audio reproduction system using the second set of modifications; and outputting the speech reproduced through the audio reproduction system using the second set of modifications and the one of the first communication device and the second communication device to the first user while the one of the first communication device and the second communication device is in the first ambient environment.

9. The method of claim 7, further comprising:

performing the speech intelligibility test using a second communication device associated with the first user in the first ambient environment, wherein modifying at least a first sound parameter of an audio reproduction system includes applying a second set of modifications that include a second modification to at least the first sound parameter;

reproducing speech through the audio reproduction system using the second set of modifications; and outputting the speech reproduced through the audio reproduction system using the second set of modifications and the second communication device to the first user while the second communication device is in the first ambient environment.

10. The method of claim 1, wherein modifying the at least the first sound parameter of an audio reproduction system based on the results of the speech intelligibility test is performed without any user input other than user responses provided as part of the speech intelligibility test.

11. The method of claim 1, further comprising: performing a plurality of speech intelligibility tests for the first user based on a plurality of communication environments, wherein modifying the at least first sound parameter of the audio reproduction system further comprises dynamically modifying a plurality of sound parameters of the audio reproduction system based on the results of the plurality of speech intelligibility tests, and wherein the plurality of sound parameters are dynamically modified based on a change from a first communication environment to a second communication environment.

12. A system for improving the intelligibility of reproduced speech, comprising:

a communication server, including:

a processor;

memory;

a communication interface; and application programming stored in the memory and executed by the processor, wherein the application programming is operable to:

administer a speech intelligibility test to at least a first user over a first network;

determine that the first user is involved in a communication session over the first network; and in response to determining that first user is involved in the communication session over the first network, adjust parameters of a speech signal provided to the first user in the communication session based on results of the speech intelligibility test.

13. The system of claim 12, further comprising:

storing the adjusted parameters of the speech signal.

14. The system of claim 12, wherein the application programming administers the speech intelligibility test to the first user in connection with at least one of a first network and a first communication endpoint to obtain a first set of adjustment parameters, wherein the application programming administers the speech intelligibility test to the first user in connection with at least one of a second network and a second communication endpoint to obtain a second set of adjustment parameters, and wherein the first and second sets of adjustment parameters are stored.

15. The system of claim 14, further comprising:

a first network;

a second network; and a first communication device, wherein the first set of adjustment parameters are obtained while the first communication device is interconnected to the communication server by the first network, and wherein the second set of adjustment parameters are obtained while the first communication device is interconnected to the communication server by the second network.

16. The system of claim 15, wherein the first network is associated with a first audio encoding algorithm, and wherein the second network is associated with a second audio encoding algorithm.

17. The system of claim 14, further comprising:

a first network;

a first communication device, wherein the first set of adjustment parameters are obtained while the first communication device is interconnected to the communication server by the first network; and a second communication device, wherein the second set of adjustment parameters are obtained while the second communication device is interconnected to the communication server by the first network.

18. The system of claim 17, wherein the application programming is further operable to:

detect the communication device associated with the user;

in response to detecting the first communication device, apply the first set of adjustment parameters; and in response to detecting the second communication device, apply the second set of adjustment parameters.

19. A tangible computer readable medium having stored thereon computer executable instructions, the computer executable instructions causing a processor to execute a method for adjusting audible signal characteristics, the computer readable instructions comprising:

instructions to administer a speech intelligibility test to a first user through a first communication device over a first network;

instructions to determine that the first user is involved in a communication session over the first network;

instructions to adjust an audible signal characteristic based on results of the speech intelligibility test in response to determining that the first user is involved in the communication session over the first network, wherein a first set of adjusted audible signal characteristics are obtained;

instructions to apply the first set of adjusted audible signal characteristics to provide a speech signal to the first user in the communication session; and instructions to store the first set of adjusted audible signal characteristics.

20. The tangible computer readable medium of claim 19, further comprising:

instructions to administer the speech intelligibility test to a second user through a second communication device;

instructions to adjust an audible signal characteristic in response to administering the speech intelligibility test to the second user through the second communication device, wherein a second set of adjusted audible signal characteristics are obtained;

instructions to apply the second set of adjusted audible signal characteristics to provide a speech signal to the second user;

instructions to store the second set of adjusted audible signal characteristics;

instructions to apply the first set of adjusted audible signal characteristics to a speech signal directed to the first user; and instructions to apply the second set of adjusted audible signal characteristics to a speech signal directed to the second user.

* * * * *